United States Patent [19]

Makino et al.

[11] Patent Number: 4,651,471

[45] Date of Patent: Mar. 24, 1987

[54] EDGE-ROUNDING METHOD AND APPARATUS THEREFOR

[75] Inventors: Masashi Makino, Toyonaka; Kunio Nakada, Suita; Isao Muragishi, Osaka; Syozi Nishitani, Higashiosaka, all of Japan

[73] Assignee: Matsushita Electric Industrial Co., Ltd., Kadoma, Japan

[21] Appl. No.: 726,378

[22] Filed: Apr. 23, 1985

[51] Int. Cl.[4] ..... B24B 9/00

[52] U.S. Cl. ..... 51/3; 51/326; 51/97 R

[58] Field of Search ..... 51/3, 326, 95 R, 95 WH, 51/97 R, 5 R, 4, 262 R, 326, 145 T, 135 R, 165.7

[56] References Cited

U.S. PATENT DOCUMENTS

| | | | |
|---|---|---|---|
| 3,321,871 | 5/1967 | Balamuth et al. | 51/262 R |
| 4,216,628 | 8/1980 | Wada | 51/98.5 |
| 4,461,121 | 7/1984 | Motzer et al. | 51/3 |
| 4,520,595 | 6/1985 | Diener | 51/3 |

FOREIGN PATENT DOCUMENTS

| | | | |
|---|---|---|---|
| 1442101 | 7/1976 | United Kingdom | 51/145 T |

*Primary Examiner*—Robert P. Olszewski
*Assistant Examiner*—Maurina Rachuba
*Attorney, Agent, or Firm*—Wenderoth, Lind & Ponack

[57] ABSTRACT

An edge-rounding method and an apparatus therefor, for chamfering the peripheral edge of a workpiece having a planar surface by causing the peripheral edge to be be engaged under pressure with a grinding surface of a grinding device. The grinding device employed is of two types, one type being a grinding cylinder having a grinding surface and the other type being an abrasive tape having an abrasive surface and moved around a rotary drum. The edge-rounding is performed on the workpiece so as to satisfy the relationship of $[(x/r)-(L/2r)]<0.015$, wherein r represents the radius of the grinding surface, L represents the minimum dimension of the planar surface during the rotation of the workpiece and x represents the distance between the plane in which the workpiece pivots and the axis of rotation of the grinding device.

13 Claims, 14 Drawing Figures

EDGE-ROUNDING METHOD AND APPARATUS THEREFOR

BACKGROUND OF THE INVENTION

The present invention relates to an edge-rounding method and an apparatus therefor, which are mainly suited for use in the manufacture of a floppy disc head, i.e., a magnetic head for recording and/or reproducing information on a floppy disc.

Referring to FIG. 1 of the accompanying drawings, the floppy disc head A (workpiece to be edge-rounded) is a generally rectangular cubic body made of a fragile material such as ceramic. A peripheral edge 2 on one of the opposite major surfaces (i.e., a to-be-ground surface 1) thereof is so chamfered as to avoid any possible damage to the floppy disc with which it is in sliding contact. The transition portion between a flat area 3 in the major surface or to-be-ground surface 1 and a rounded corner 2*a* is required to be smoothed with high preciseness.

FIG. 2 illustrates the cross-sectional profile of the head A taken in a direction parallel to the short axis Y lying on the to-be-ground surface 1. As shown, in order for the head A to function optimally, the standards stipulate that the smoothness of the transition area in the direction of the short axis Y must be within a tolerance of a/b=0.003 mm/0.020 mm. When this is expressed in terms of the angle $\theta$ of inclination of a curved surface of the rounded corner 2*a* at the transition area, the inclination angle will be 0.86°, and it it is therefore required that said curved surface be formed so as to have an inclination angle $\theta$ smaller than 0.86°.

A prior art edge-rounding machine capable of effecting a highly precise edge-rounding is illustrated in FIGS. 3 and 4.

In this prior art edge-rounding machine, the edge-rounding is carried out by the use of a grinding device 6 having an abrasive sheet 5 mounted on a rotary disc 18 by means of an elastic sheet 4, and a workpiece holder assembly 7 capable of imparting to the workpieces A rotary and pivotal motions and a biasing force acting in a direction parallel to the axis of rotation of the workpieces A.

As shown, the holder assembly 7 is provided with three holders 8 for the support of the respective workpieces A with their to-be-ground surfaces oriented downwards, such that the three workpieces A can be simultaneously processed. As best shown in FIG. 4, each of the holders 8 is capable of being rotated by a motor 9 about the axis P′ of rotation concentric with the longitudinal axis thereof so as to impart rotary motion to the respective workpiece A. In addition, each holder 8 is supported by a holder support 10 for movement up and down and is normally urged downwards by a spring 11. As a result, each of the workpieces A is urged in a direction parallel to the axis P′ of rotation with the peripheral edge 2 of the to-be-ground surface 1 elastically loaded to contact the abrasive sheet 5 positioned therebelow. The holder support 10 is fitted to a free end of a rocking arm 12 and is capable of pivoting about an axis Q′ within a predetermined angle $\alpha'$ incident to the rocking motion of the rocking arm 12. Therefore, the holder 8 and, hence, the associated workpiece A, is given a pivotal motion about the axis Q′ in FIGS. 3 and 4. In FIGS. 3 and 4, reference numeral 13 designates a cranking mechanism for rocking the rocking arm 12, reference numeral 14 designates a piston-cylinder device for moving the workpiece holder assembly 7 up and down relative to a machine framework, and reference numeral 16 designates a motor for rotating the rotary disc 18 of the grinding device 6.

According to the prior art, and as hereinabove described, the edge-rounding is performed by causing the peripheral edge 2 of the to-be-ground surface 1 of each workpiece A to contact under pressure the abrasive sheet 5 of the grinding device 6 while the respective workpiece A is rotated, pivoted and urged in the direction parallel to the axis P′ of rotation. The range of the angle through which the respective workpiece A is pivoted lies on one side of a vertical line V′ passing through the pivot axis Q′ and perpendicular to the abrasive sheet 5, thereby avoiding the possibility of the flat area 3 of the workpiece A contacting the abrasive sheet 5, i.e., to avoid the formation of traces of grinding on the flat area 3 of the workpiece A. In addition, when the workpiece A is pivoted to a position closest to the vertical lines V′ as shown by the phantom line in FIG. 4, the machining of the curved surface at the transition area between the flat area 3 and the rounded corner 2*a* is carried out. At this time, the elastic sheet 4 underlying the abrasive sheet 5 is elastically deformed to permit the edge-rounding to result in the inclination angle $\theta$ smaller than 0.86°.

However, it has been found that the prior art method described above has the following disadvantages.

(i) Initial deviations, and changes with time, of the elastic modulus, surface hardness and other factors of the elastic sheet 4 adversely affect the inclination angle $\theta$ and, therefore, the quality of the workpieces A which have been edge-rounded tends to be unstable.

(ii) The standards for the shape of the curved surface of the edge-rounded corner 2*a* vary with the type of machine in which the floppy disc head is employed. In order for workpieces A to be manufactured which have different shapes of edge-rounded corners 2*a*, a number of different kinds of elastic sheets 4 must be prepared, and in practice the various different elastic sheets must be chosen by trial and error to achieve the manufacture of floppy disc heads for the particular types of machines. In addition, complicated grinding conditions must be selected.

(iii) Since according to the prior art described above the entire process from the coarse grinding to the final grinding is performed on the single abrasive sheet 5 on the rotary disc 18, not only is the grinding efficiency low, but also the manufacturing cost is high as a result of the consumption of the abrasive sheet, which in turn brings about an increased price of the resultant product.

(iv) The prior art method employs a batch system wherein a grinding machine is employed for each process step of coarse grinding to final grinding. Therefore, each time the workpieces are transferred from one process step to another, the workpieces have to be removed from the grinding device and, therefore, not only can grinding with high preciseness be rather difficult, but also the productivity is very low.

SUMMARY OF THE INVENTION

The present invention has been developed with a view to substantially eliminating the above described disadvantages and inconveniences inherent in the prior art method and machine and has for its essential object to provide an improved edge-rounding method and an apparatus therefor which are excellent in all aspects including grinding preciseness, uniformity in quality of product, ease in changing grinding conditions, and productivity.

As herein disclosed, the present invention pertains to an edge-rounding method applicable to a workpiece having a planar surface to be ground for rounding a peripheral edge of the planar surface while the peripheral edge is engaged under pressure with a grinding surface of a grinding device. As one of the features of the present invention, the grinding device has a cylindrical rotor in the form of a grinding cylinder having its outer peripheral surface provided with grinding media, or a rotary drum around which an abrasive tape is moved. With this grinding device, the edge-rounding is performed by engaging the peripheral edge of the workpiece with the grinding surface driven in the circumferential direction of the grinding device.

During the edge-rounding operation, the workpiece is rotated about an axis of rotation perpendicular to the planar surface while being pivoted in a plane containing the axis of rotation of the workpiece and extending parallel to the axis of rotation of the grinding device, said workpiece being displaceable in a direction parallel to the axis of rotation of the workpiece and being urged towards the grinding surface with the peripheral edge consequently held in contact with the grinding surface.

In addition, the edge-rounding is carried out on the workpiece so as to satisfy the following relationship:

$$(x/r)-(L/2r)<0.015$$

wherein r represents the radius of the grinding surface, L represents the minimum dimension of the planar surface during the rotation of the workpiece, and x represents the distance between the plane in which the workpiece pivots and the axis of rotation of the grinding device.

The method according to the present invention can be maximized when used in connection with the edge-rounding of a plurality of workpieces. In such case, the workpieces are arranged in a row in a direction parallel to the axis of rotation of the grinding cylinder or the rotary drum.

The present invention also pertains to an apparatus for carrying out a grinding operation on a workpiece having a planar surface with a chamfered edge, the operation being carried out at a plurality of grinding stations. This system is characterized in that a first grinding device comprising a grinding cylinder having its outer periphery serving as a grinding surface and a second grinding device comprising a rotary drum around which an abrasive tape having its outer surface serving as a grinding surface is moved, are disposed at pre-grinding and post-grinding zones, respectively.

In this system, the workpiece is, while being carried by a holder assembly, given rotary and pivotal motions and an urging it force for urging in a direction parallel to the axis of rotation of the workpiece, and the holding assembly is, while carrying the workpiece, successively passed through the grinding stations, the peripheral edge of the planar surface being engaged under pressure with the grinding surface for edge-rounding each time the workpiece is brought in register with any one of the grinding stations.

The amount of pivotal motion of the workpiece can be selected as desired at each of the grinding stations.

BRIEF DESCRIPTION OF THE ACCOMPANYING DRAWINGS

This and other objects and features of the present invention will become clear from the following description of a preferred embodiment thereof taken in conjunction with the accompanying drawings, in which.

DETAILED DESCRIPTION OF THE EMBODIMENT

Figure 1:
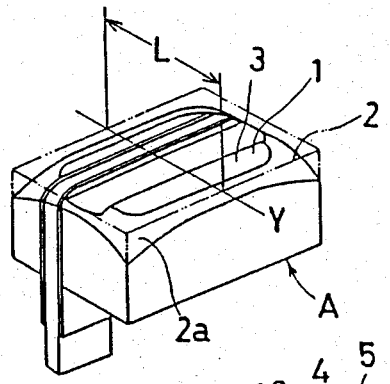
FIG. 1 is a perspective view of a floppy disc head which is an example of workpieces to be made by the method and apparatus of the present invention.
Figure 3:
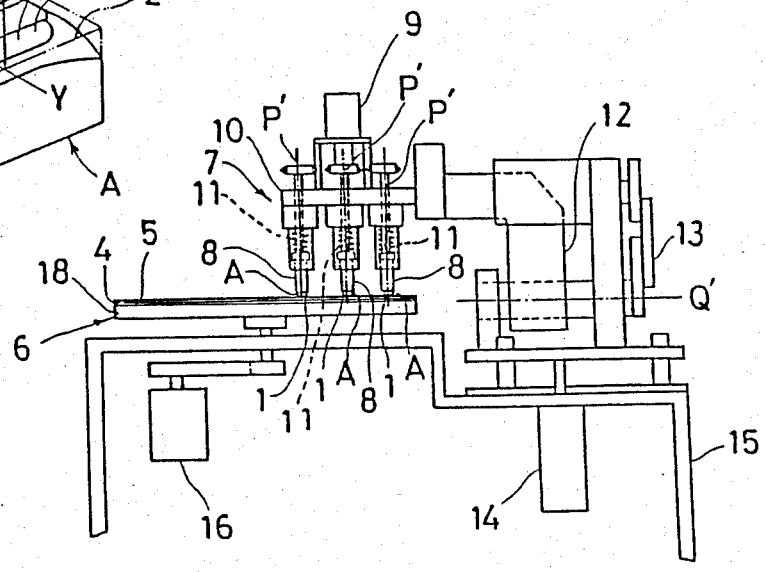
FIG. 3 Prior Art
FIG. 3 is a front elevational view of a prior art machine.

Before the description of the present invention proceeds, it is to be noted that like parts are designated by like reference numerals throughout the accompanying drawings.

Figure 5:
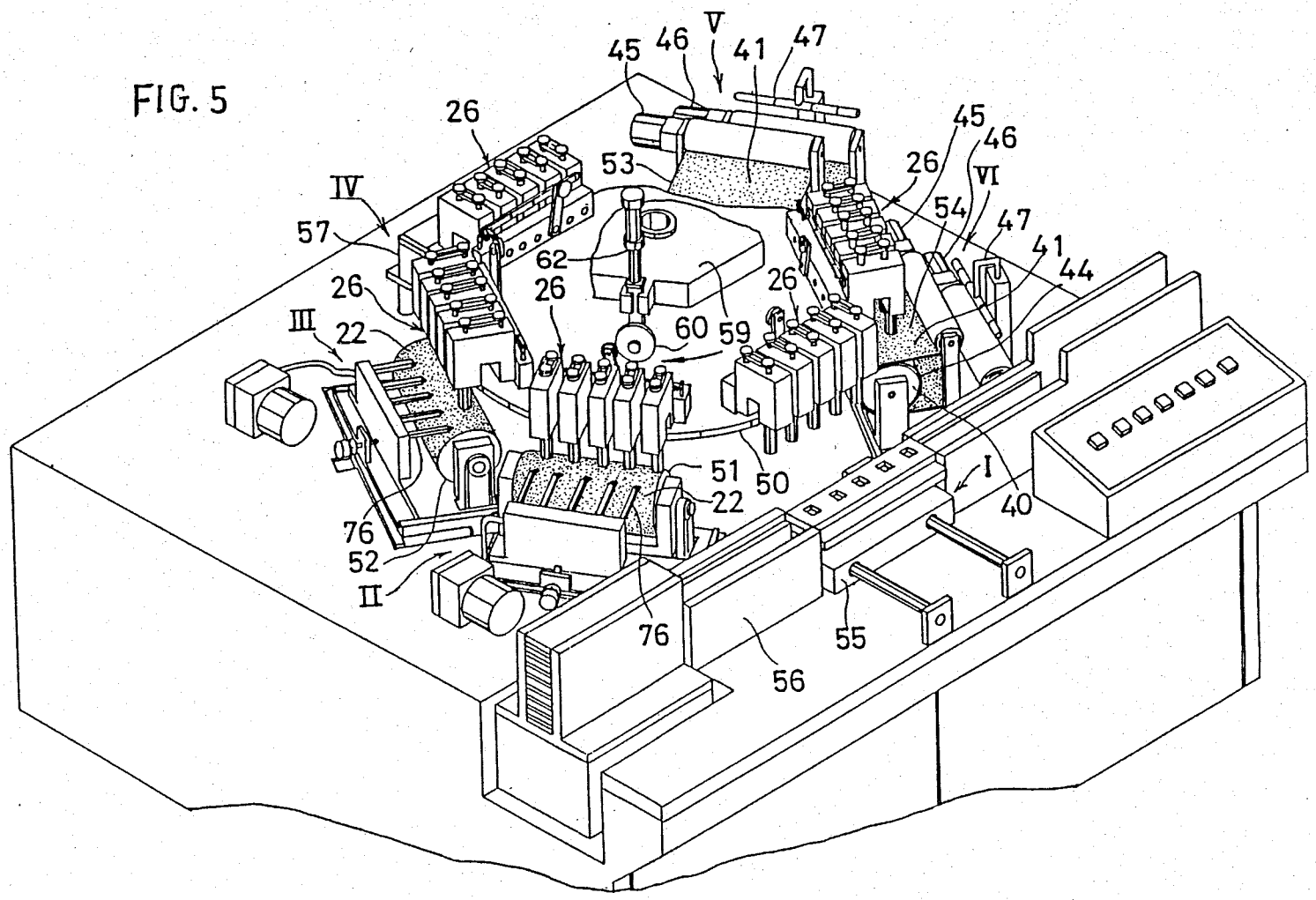
FIG. 5 is a perspective view of a grinding machine employed in the practice of the present invention.
Figure 6:
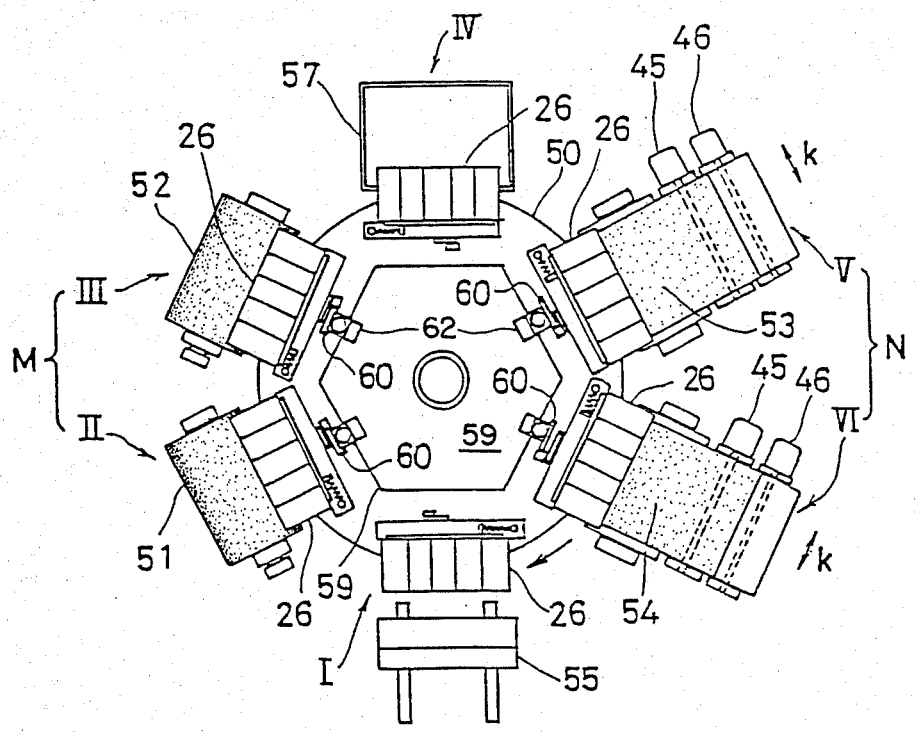
FIG. 6 is a top plan view of part of the machine shown in FIG. 5.

Referring first to FIGS. 5 and 6 which illustrate an edge-rounding machine embodying the present invention, the machine shown therein has six work stations I, II, III, IV, V and VI at which first to sixth process steps of an edge-rounding method are performed respectively. Briefly speaking, the edge-rounding method according to the present invention herein disclosed includes:

First Process Step—To be performed at the first work station I for the removal of edge-rounded workpieces from the machine and the supply of workpieces to be edge-rounded or chamfered to the machine.

Second Process Step—To be performed at the second work station II for coarse grinding.

Third Process Step—To be performed at the third work station III for medium grinding.

Fourth Process Step—To be performed at the fourth work station IV for rinsing.

Fifth Process Step—To be performed at the fifth work station V for fine grinding.

Sixth Process Step—To be performed at the sixth work station VI for finishing.

The machine herein disclosed employs a rotary indexing system by which the first to sixth process steps are sequentially performed on one or a group of workpieces A to be edge-rounded. For this purpose, the machine comprises an intermittently driven indexing turntable 50 carrying a plurality of, for example, six, holder assemblies 26 for rotation together therewith, said holder assemblies 26 being arranged on a peripheral region of said turntable 50 in circumferentially equally spaced relation to each other. The turntable 50, during each complete rotation in one direction shown by the arrow in FIG. 5, sequentially passes the work stations I to VI and is temporarily brought to a halt at each work station I to VI so that the process step assigned to the respective work station can be performed on one or a group of identical workpieces A carried by the associated holder assembly 26. Since the number of the holder assemblies 26 is equal to the number of the work stations, i.e. equal to the number the process steps of the edge-rounding method according to the present invention, it will be readily seen that each time the turntable 50 is held still during the intermittent rotation thereof, all of the holder assemblies 26 are held at the respective work stations I to VI as shown. As will be described later, and as shown, each holder assembly 26 is comprised of, for example, five, workpiece holders 27 of identical construction each adapted to support a respective workpiece A with its to-be-ground surface oriented downwards. The work to be done at each work station is as follows:

At the first work station I, the workpieces A which have been edge-rounded (hereinafter referred to as "processed workpieces") are removed from the holder assembly 26 by a workpiece supply and removal device 55 and, thereafter, workpieces A which have not yet been edge-rounded are secured to the holder assembly 26 by the workpiece supply and removal device 55. It is to be noted that the workpieces to be edge-rounded and therefore to be supplied to the device 55 and those that have been edge-rounded are transported by way of an automatic conveyance device 56.

At the second work station II, the workpiece A supported by the holder assembly 26 are subjected to coarse grinding by the use of a first grinding device 51 utilizing a coarse abrasive.

At the third work station III, the workpieces A supported by the holder assembly 26, which have been roughly edge-rounded or chamfered are subjected to medium grinding by the use of a second grinding device 52 utilizing a medium abrasive.

The process steps performed at the second and third work stations II and III by the use of the grinding devices 51 and 52, respectively, form a pre-grinding, or preliminary grinding, process M.

At the fourth work station VI, the workpieces A still supported by the holder assembly 26, but which have been ground at the third work station are washed or rinsed in an ultrasonic cleaning device 57 to remove abrasive grains and particles fragmented from the abrasive means of the devices 51 and 52 during the pre-grinding process M and which may be sticking to the workpieces A. The cleaning efficiency will be increased if the workpieces being rinsed are rotated. It is to be noted that the cleaning device 57 is so arranged as to move up and down.

At the fifth work station V, the workpieces A which have been cleaned at the preceding work station IV are subjected to fine grinding by the use of a grinding device 53 utilizing an abrasive tape. By this fine grinding, the angle $\theta$ of inclination of each of the workpiece, which has been referred to hereinbefore, is reduced to a value smaller than the desired value. The grinding device 53 employed at this work station V comprises a rigid rotary drum 40 about which the abrasive tape 41 is carried as will be described later.

At the sixth work station VI, the workpieces A transferred from the fifth work station V are subjected to the final grinding by the use of a grinding device 54 utilizing an abrasive tape for the purpose of removing any sharp edge remaining on the to-be-ground surface of each of the workpieces A thereby to smooth such surface. At this work station VI, the grinding device 54 employed comprises a rotary drum 40 having its outer peripheral surface covered by an elastic sheet 44, (which drum is hereinafter referred to as "rubber-surfaced drum" in contrast to the rigid drum used in the grinding device 53 at the fifth work station,) about which rubber-surfaced drum the abrasive tape 41 is moved as will be described later.

The process steps performed at the fifth and sixth work stations V and VI by the use of the grinding devices 53 and 54, respectively, form a post-grinding process N.

Figure 8:
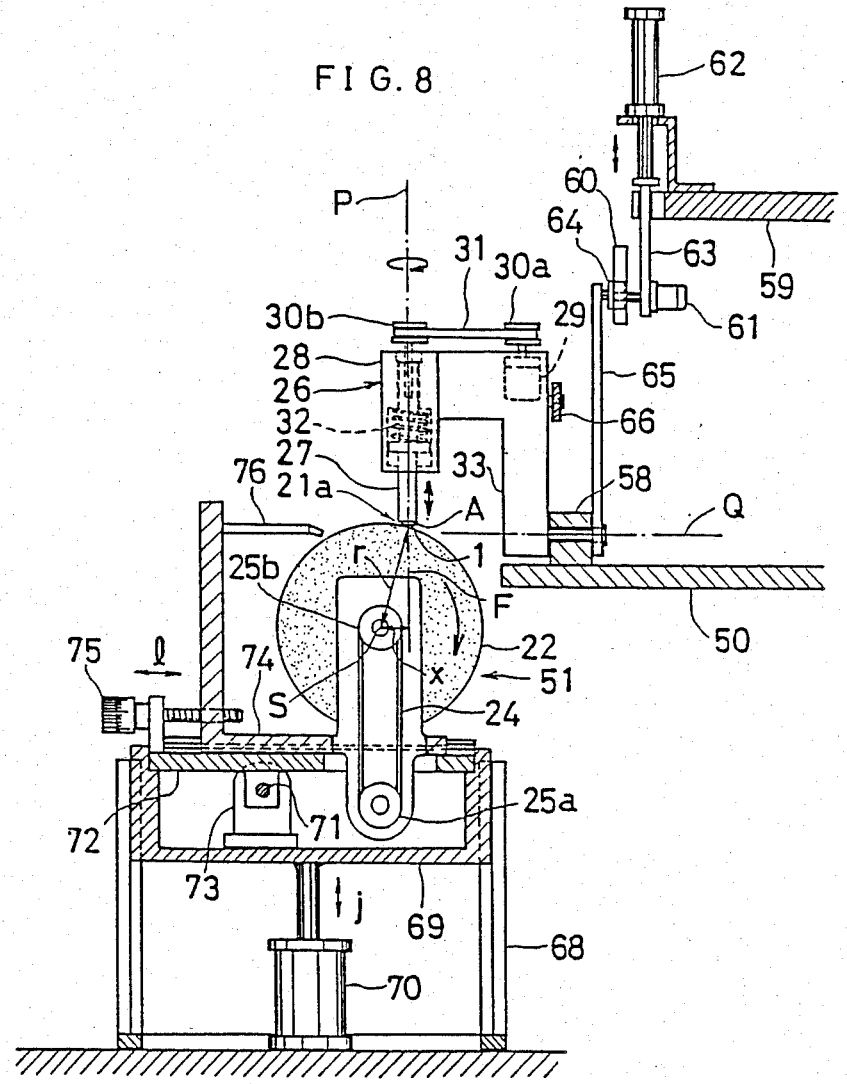
FIG. 8 is a vertical sectional view showing a grinding device forming part of the machine of FIG. 5 utilizing a grinding cylinder.
Figure 13:
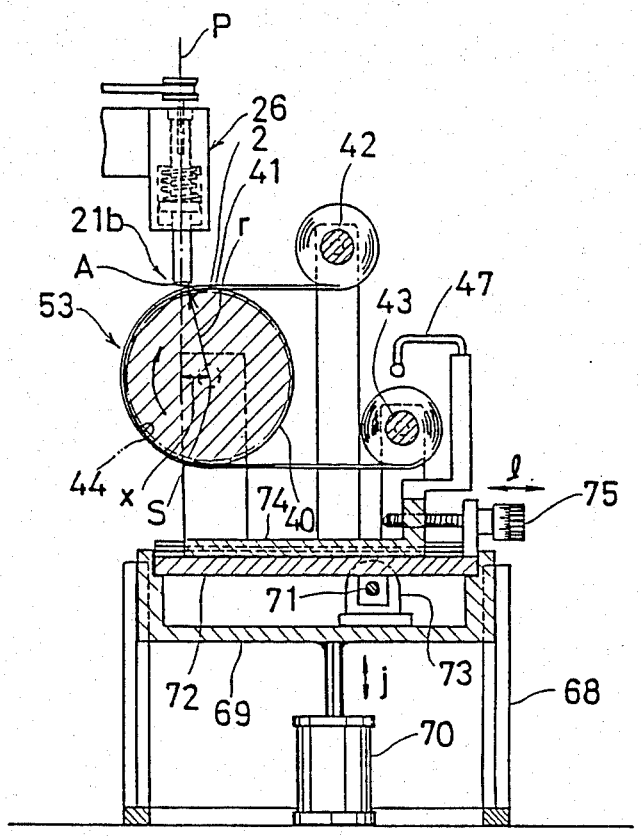
FIG. 13 is a vertical sectional view of a grinding device forming part of the machine of FIG. 5 utilizing an abrasive tape.

As best shown in FIGS. 8 and 13, each of the holder assemblies 26 is provided with the five workpiece holders 27 each for removably supporting a respective workpiece A with the to-be-ground surface 1 thereof oriented downwards. Each workpiece holder 27 is supported by a respective holder support 28 for rotation about the longitudinal axis thereof and also for movement in a direction axially thereof and is adapted to be driven by a respective motor 29, the drive of which motor 29 is transmitted thereto through an endless timing belt 31 reeved between spaced drive and driven pulleys **30*a* and 30*b*. Thus, it will readily be seen that each of the workpiece holders 27 can rotate about the center axis P passing through the center of the respective holder 27 in alignment with the longitudinal axis thereof to rotate the associated workpiece A. Each of the holder supports 28 one for each holder 27 has a spring 32 built therein, which spring 32 acts to urge the associated holder 27 downwards in a direction parallel to the center axis P. Accordingly, each time the holder assemblies 26 are successively brought into alignment with the second, third, fifth and sixth work stations II, III, V and VI, the peripheral edges 2 of the to-be-ground surfaces 1 of the respective workpieces A are displaced downwards in a direction parallel to the center axes P to contact grinding surfaces 21*a* and 21*b* in the associated grinding devices 51, 52, 53 and 54**.

Figure 10:
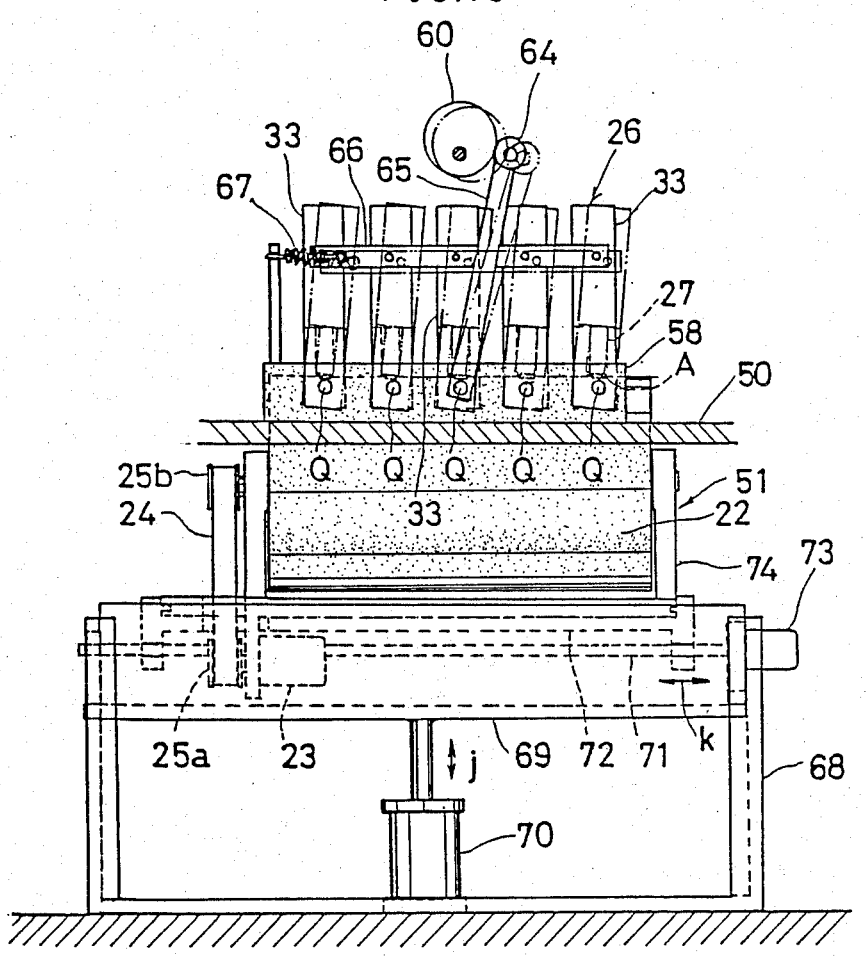
FIG. 10 is a rear view of the grinding device shown in FIG. 8.

The holder supports 28 are fitted to top portions of respective rocker arms 33 each configured so as to be a substantially inverted figure "L", which rocker arms 33 have their lower end portions mounted on a common foundation 58, rigidly mounted on the turntable 50 adjacent the periphery thereof, for pivotal movement about respective rocking axes Q parallel to the horizontal direction. Thus, the rocker arms 33 including the workpiece holders 27 in each of the holder assemblies 26 can be pivoted about the respective rocking axes Q, when each holder assembly 26 is brought to any one of the second, third, fifth and sixth work stations II, III, V and VI, in a plane perpendicular to any one of the rocking axes Q and containing the respective center axes P while they remain in parallel relation to one another as shown in FIG. 10.

The pivotal movement of the rocker arms 33 and, hence, the workpiece holder 27 in each of the holder assemblies 26 can be effected by a cam mechanism which comprises a cam wheel 60 and a drive motor 61, one set of a cam wheel 60 and a drive motor 61 being employed for each of the second, third, fifth and sixth work stations II, III, V and VI, and being arranged on a fixed table 59, which is coaxially supported above the turntable 50, by a respective pneumatic cylinder 62. More specifically, referring to FIG. 8 in combination with FIG. 6, the fixed table 59 fixedly supported above the turntable 50 in coaxial relation thereto has four pneumatic cylinders 62 rigidly mounted thereon in alignment with the second, third, fifth and sixth work stations II, III, V and VI with their piston rods extending downwards towards the turntable 50. The piston rods of the respective cylinders 62 have their free ends carrying respective support plates 63, each of which plates 63 carries the respective motor 61 having its drive shaft coupled with the associated cam wheel 60 for rotation together therewith. It is to be noted that, during the intermittent rotation of the turntable 50, the pneumatic cylinders 62 are held in position with their piston rods retracted and, hence, with the support plates 63 shifted upwards so as to avoid any possible interference between the cam wheels 60 and cam followers 64 which will be described later.

One of holder units of each holder assembly 26 is provided with a rocking lever 65 for translating the rotation of the associated cam wheel 60 into the pivotal movement performed by the rocker arms 33 about the rocking axes Q, said cam follower 64 being rotatably mounted on an upper end of the rocking lever 65 for engagement with the cam wheels 60 one at a time. The holder units of each holder assembly 26 are so linked together by a connecting link 66 that all of the holders 27 of each holder assembly 26 can be simultaneously pivoted in the same direction Reference numeral 67 designates a tension spring used for each holder assembly 26 for urging the cam follower 64 to contact the cam wheel 60 under pressure.

One of the features of the present invention is that, at each of the second, third, fifth and sixth work stations II, III, V and VI, the amount of pivotal movement of each holder assembly 26 and, hence, the amount $\alpha$ of pivoting of each workpiece A in each holder assembly 26 can be chosen as desired. Specifically, the choice of the amount $\alpha$ of pivoting can readily be accomplished by selecting a particular shape and size of the cam wheel 60 at each of the work stations II, III, V and VI. It is to be noted that the above described pivotal movement can be accomplished by the use of any suitable cranking mechanism other than the above described cam mechanism.

As hereinbefore described, during each complete intermittent rotation of the turntable 50 in the direction shown by the arrow, the workpieces A carried by the respective holders 27 in each holder assembly 26 are sequentially passed through the first to sixth work stations and then back to the first work station. When the workpieces A return to the first work station I after having moved past the second to sixth work stations II to VI sequentially, it means that they have been completely edge-rounded and, therefore, they are removed from the associated holder assembly 26 for replacement with the next succeeding group of workpieces to be egde-rounded.

Figure 9:
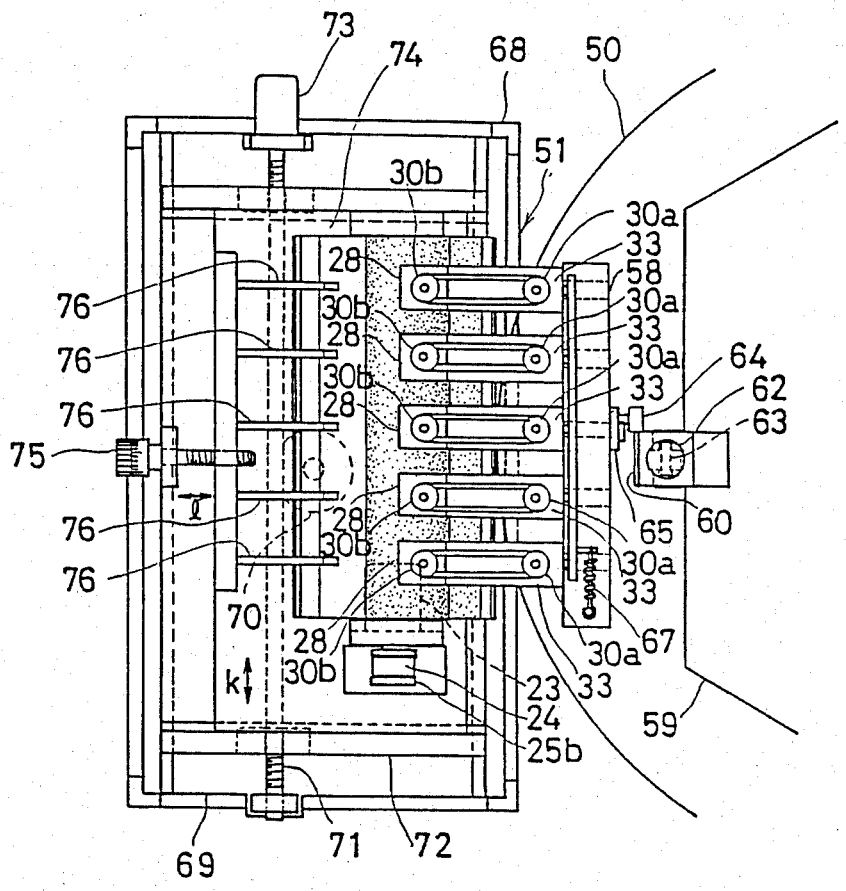
FIG. 9 is a top plan view of the grinding device shown in FIG. 8.

Referring now to FIGS. 8 to 10, the first grinding device 51 provided at the second work station II includes a coarse grinding cylinder 22 supported for movement in a direction up and down relative to a machine framework 68. Reference numerals 69 designates a first deck capable of being moved up and down by a pneumatic cylinder 70 while being guided by the machine framework 68. The coarse grinding cylinder 22 can be traversed in a direction k parallel to the longitudinal axis thereof and, for this purpose, a feed screw 71 is adjustably supported by the first deck 69 for reciprocately driving a second deck 72 in the direction k. The feed screw 71 can be rotated in opposite directions about its own longitudinal axis by a reversible motor 73. Also, the coarse grinding cylinder 22 can be moved to any desired position in a direction l towards and away from the turntable 50 and, for this purpose, a support table 74 for the support of the grinding cylinder 22 can be adjustably moved in the direction l by means of a position adjusting screw 75 mounted on the second deck 72 so that, by turning the screw 75, the grinding cylinder 22 can be moved so as to adjust a value x, as will be described later, to any desired value.

In addition to the grinding cylinder 22, the support table 74 has mounted thereon a motor 23 for driving the grinding cylinder 22 and five dispensers 76 for supplying grinding liquid onto the grinding cylinder 22. The drive of the motor 23 can be transmitted to the grinding cylinder 22 by means of an endless belt 24, reeved between drive and driven pulleys **25*a* and 25*b*, thereby to rotate the grinding cylinder 22 in a downward-cutting direction shown by the arrow in FIGS. 8 and 11**.

The grinding cylinder 22 can, each time any one of the holder assemblies 26 is brought into alignment with, and held still at, the second work station II as a result of the intermittent rotation of the turntable 50, be moved upwards by the pneumatic cylinder 70 and then held still at an operative position as shown in FIG. 8. At this time, the minimum distance x measured between the axis S of rotation of the grinding cylinder 22 and the plane F in which the holder assembly 26 is pivoted is selected to have a value suitable for the coarse grinding operation to be carried out on the workpieces A then held at the second work station II.

Figure 11:
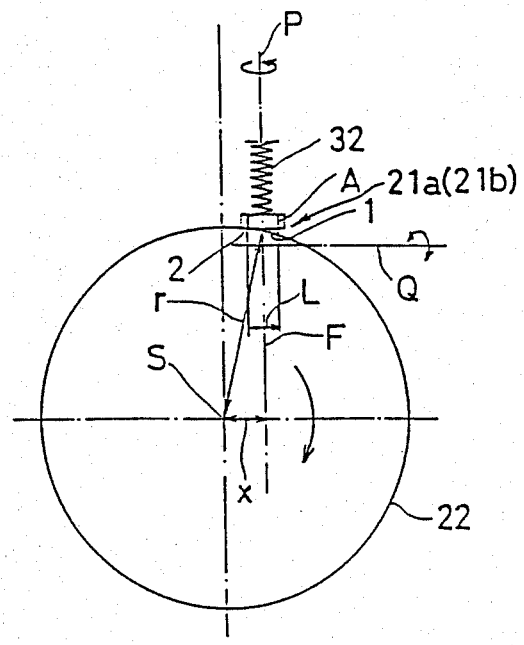
FIG. 11 is a schematic end elevational view used to explain the principle of the method according to the present invention.

Even at any one of the third, fifth and sixth work stations III, V and VI, the minimum distance x as defined above can be chosen to be any desired value. Specifically, the minimum distance x to be chosen at the fifth work station V where the fine grinding is performed is preferred to be such as to satisfy the relationship.

$$[(x/r)-(L/2r)]<0.015$$

where L represents the minimum dimension during the rotation of the to-be-ground surface 1 of each workpiece A (which corresponds to the width in the direction of the short axis Y of each workpiece as shown in FIG. 1) and r represents the radius of the grinding surface **21*b* in the grinding device 53 (see FIG. 11**).

It is to be noted that the fine grinding can be performed by the use of a cylindrical rotor having its outer peripheral surface provided with cutting media, such as the grinding cylinder 22 (in which case r will be the radius thereof).

Figure 12:
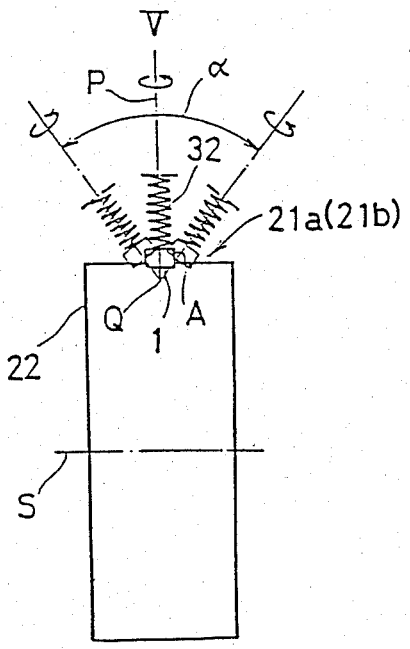
FIG. 12 is a schematic front view of FIG. 11.

As best shown in FIG. 12, all of the pivot axis Q in each holder assembly 26 are so selected as to be positioned below the to-be-ground surface 1 of each workpiece A, and the amount $\alpha$ of pivoting of each workpiece A is within a predetermined angle having the opposite limits located on respective sides of, and spaced an equal distance from, the associated reference line V passing through the pivot axis Q in parallel to the vertical line.

The grinding device 52 positioned at a third work station III for performing the medium grinding operation on the workpieces A is substantially identical with the grinding device 51 at the second work station II except for the different values of the spacing x in the respective devices 51 and 52.

Referring particularly to FIG. 13, the grinding device 53 utilizing the abrasive tape 41 comprises a rigid drum 40 around which the abrasive tape 41 is moved. The abrasive tape 41 has a grinding surface **21*b* which is, during the travel of the abrasive tape 41 around the rigid drum 41, adapted to slidingly contact the peripheral edge 2 of each workpiece A in an upward-cutting direction to round the peripheral edge 2**.

The rigid drum 40 is supported for idle rotation about an axis of rotation concentric with the longitudinal axis of said drum 40, and the abrasive tape 41 has its opposite ends rolled around winding and rewinding rolls 42 and 43, respectively. These winding and rewinding rolls 42 and 43 are drivingly coupled with respective motors 45 and 46, as shown in FIG. 6, for rotating the rolls 42 and 43 one at a time. When the winding roll 42 is driven in one direction, the abrasive tape 41 travels in the direction shown by the arrow in FIG. 13 thereby to effect the fine grinding operation on each workpiece A. It is to be noted that the grinding device 53 may be so constructed as to drive the rigid drum 40 to move the abrasive tape 41.

As is the case with each of the grinding devices 51 and 52, the grinding device 53 is so constructed as to be movable in three directions, i.e., the direction j parallel to the vertical direction, the direction k (see FIG. 6) parallel to the longitudinal axis of the drum 40, and the direction l towards and away from the associated holder assembly 26 then at the fifth work station V. The relationship of the position of the grinding device 53 to the holder assembly 26 then brought in register with the fifth work station V is also identical with that of either one of the grinding devices 51 and 52 to the holder assembly 26 then brought in register with the second or third work station II or III but, however, the amount $\alpha$ of pivoting of each workpiece A, in relation to the grinding device 53 at the fifth work station, is adjusted to a very small value.

In FIG. 13, reference numeral 47 designates a magnetic shower for the removal of static electricity generated in the abrasive tape 41.

The grinding device 54 utilizing the abrasive tape for the final grinding, which device is positioned at the sixth work station VI, is basically identical with the grinding device 53 at the fifth work station V. However, since the final grinding operation performed at the sixth work station VI is for the purpose of removing the sharp edge remaining on each workpiece A and is to be performed without incurring any formation of scratches and/or cuts, the grinding device 54 differs from the grinding device 53 in that the abrasive tape 41 used in the grinding device 54 is caused to contact the rotary drum 40 through an elastic sheet 44 as shown in FIG. 5.

With the edge-rounding machine so constructed as hereinabove described, the workpieces A carried by any one of the holder assemblies 26 are, during one complete rotation of the turntable 50, intermittently moved past the first to sixth work station I to VI. At the second and third work stations, the pre-grinding process M is performed by the grinding cylinders 22 on the workpieces A. Subsequent to the pre-grinding process M, the workpieces A are rinsed by the ultrasonic cleaning device 57 at the fourth work station IV and are then subjected to the post-grinding process N performed at the fifth and sixth work stations V and VI, which post-grinding process N includes the fine and final grinding operations. After the post-grinding process, the workpieces A are transferred back to the first work station I for the removal of the processed workpieces from the associated holder assembly 26. Thus, it will be readily understood that each workpiece A receives the four grinding operations during the transportation thereof from the first work station I back to the first work station and, therefore the highly precisely edge-rounded workpieces can be obtained according to the present invention.

Figure 7:
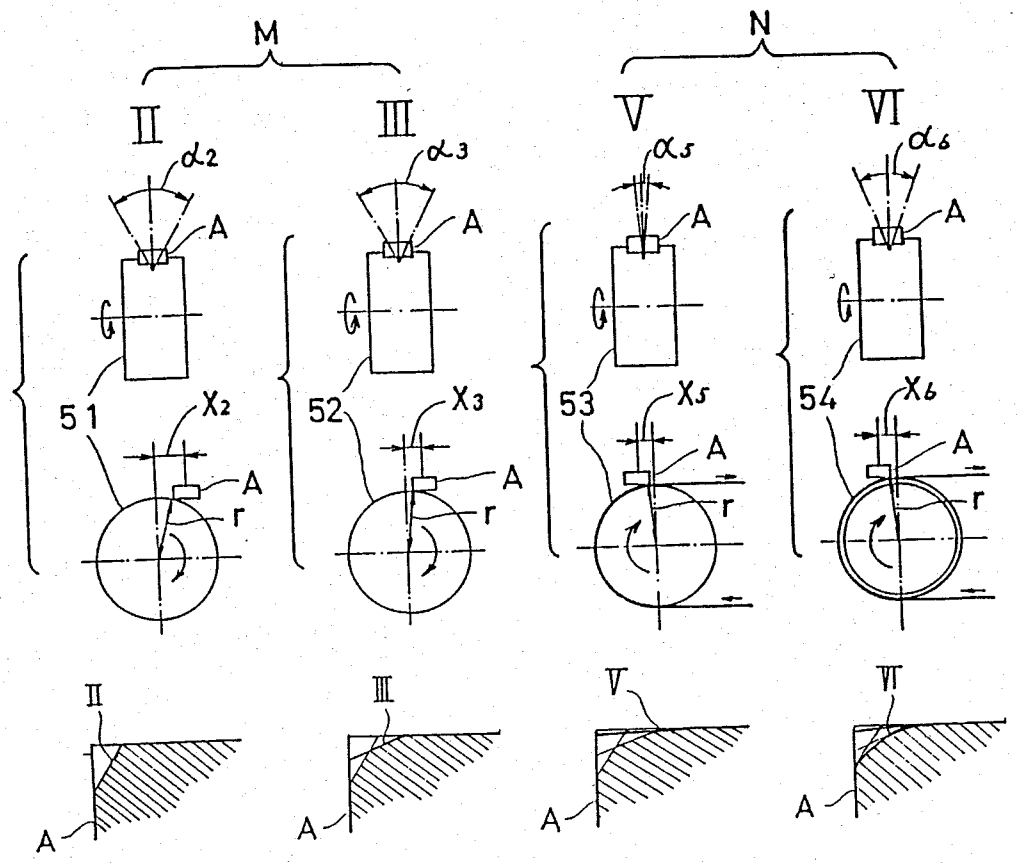
FIG. 7 is a series of diagrams showing different grinding conditions used at different grinding work stations.

In each of the second, third, fifth and sixth work stations II, III, V and VI, optimum processing conditions are chosen, an example of which will now be described with reference to FIG. 7. It is to be noted that, in FIG. 7, the conditions of each workpiece A being ground are also sequentially shown.

$r=100$ mm, $\alpha_2=\pm 40°$, $\alpha_3=\pm 40°$, $\alpha_5=\pm 1°$, $\alpha_6=\pm 40°$ $x_2=12.0$ mm, $x_3=3.2$ mm, $x_5=2.3$ mm, $x_6=3.0$ mm.

The present invention can be changed or modified in numerous ways other than the preferred embodiment described above. By way of example, although each of the pre-grinding and post-grinding processes has been described as including the two grinding operations, it may include one or more than three grinding operations using one or more than three similar grinding devices using a grinding cylinder or an abrasive tape.

In addition, instead of the rotary indexing system described and shown, a line indexing system may be employed.

The edge-rounding system according the present invention can bring about the following effects:

(1) Since both of the grinding devices employed in the apparatus of the present invention are devices in which the grinding is basically carried out at the outer periphery of a rigid cylinder and since the shape of the to-be-ground surface of each of the workpieces is determined by the geometry of the positions of the workpiece and the grinding device, the highly precisely ground workpieces having a stabilized ground surface can be manufactured unlike the conventional method wherein the elastic deformation of the elastic sheet is utilized. Therefore, the quality of the products can be rendered uniform and excellent.

(2) Since the system of the present invention is such that during the pre-grinding process, a multiple grinding is performed by the use of the grinding devices utilizing the grinding cylinders, and during the post-grinding process a multiple grinding is performed by the use of a grinding device utilizing the abrasive tapes, not only can a highly efficient edge-rounding operation be carried out, but the quality of the products can be made uniform as compared with the conventional method. In addition, the problem of the increased cost of manufacture resulting from the wear of the abrasive sheets such as in the conventional method can be eliminated.

(3) Since the system of the present invention is so designed that the amount of pivoting of each workpiece which would considerably affect the preciseness of the products can be selected as desired at each of the second, third, fifth and sixth work stations, the quality of the products can be improved.

Moreover, since the grinding conditions including, for example, the amount of pivoting of each workpiece can be readily changed when any change or modification occurs in the type and size of the workpieces, the system of the present invention is suited for use in the manufacture of products of a different type and/or size.

(4) Since in the system of the present invention, the workpieces are transported successively past the numerous grinding stations such as the second, third, fifth and sixth work stations while carried by each holder assembly, the productivity of the products can be increased as compared with the batch system employed in the conventional system. Moreover, since in the system of the present invention, no workpiece need be removed in the course of carrying out the method, no error occurs in the position of the workpieces being carried by each holder assembly and, therefore, both the quality and preciseness can be maintained at a high level.

The edge-rounding method according to the present invention is such that, by the use of the grinding devices each comprising the cylindrical rotor 22 such as, for example, the grinding cylinder, having its outer peripheral surface provided with cutting media, or the grinding devices 53 and 54 each comprising the rotary drum 40 around which the abrasive tape 40 is moved, the edge-rounding is carried out with the peripheral edge 2 of each workpiece A held in sliding contact under pressure with the grinding surface 21*a* or 21*b* then driven in a direction circumferentially of the grinding device. As the cylindrical rotor 22 referred to above, a rotary drum having an abrasive sheet applied to the outer periphery thereof may be employed.

According to the edge-rounding method of the present invention, each of the workpieces A to be edge-rounded is pivoted in the plane F, containing the axis P of rotation of such workpiece and extending in parallel to the axis S of rotation of the grinding device, while being rotated about the axis P of rotation perpendicular to the to-be-ground surface 1 of such workpiece A, the respective workpiece A being arranged for displacement in a direction parallel to the axis P of rotation, and at the same time, the respective workpiece A is urged towards the grinding surface 21*a* or 21*b* so as to cause the peripheral edge 2 of the to-be-ground surface 1 to be held in sliding contact with the grinding surface 21*a* or 21*b*.

Moreover, the edge-rounding method of the present invention is such that the grinding is carried out with the following equation satisfied.

$$[(x/r)-(L/2r)]<0.015 \quad \text{(I)}$$

The foregoing equation (I) stipulates the range in which the angle $\theta$ of inclination at the transition point of the to-be-ground surface 1 can be assuredly kept below 0.86° (a/b=0.003 mm/0.020 mm or below) based on a series of experiments wherein r and L are taken as respective parameters and x is taken as a variable.

Figure 14:
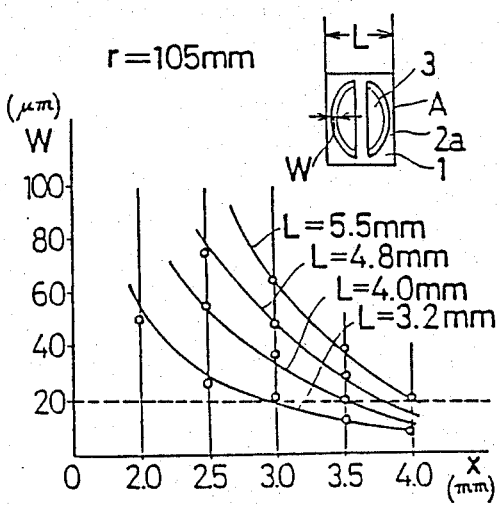
FIG. 14 is a graph illustrating the relationship between the grinding condition and an index representative of the grinding preciseness of the workpiece.

FIG. 14 illustrates data obtained when r was set at 105 mm and L was taken as a parameter. The inclination angle $\theta$ can be determined by the measurement of the space W ($\mu$m) between each adjacent interference fringes with the use of an optical flat and rays of natrium light ($\lambda=0.6$ $\mu$m). The relationship between the space W and the ratio of a/b is expressed by the following equation:

$$a/b=(0.6/2)/W=0.3/W \quad \text{(II)}$$

Accordingly, in order for the ratio of a/b to be smaller than 0.3 $\mu$m/20 $\mu$m, the space W must be greater than 20 $\mu$m.

Figure 4:
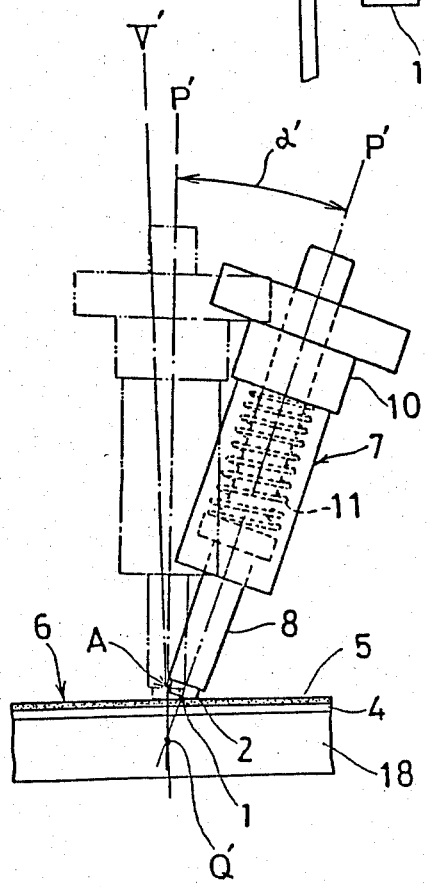
FIG. 4 Prior Art
FIG. 4 is a side view, on an enlarged scale, of an essential portion of the prior art machine shown in FIG. 3.
Figure 2:
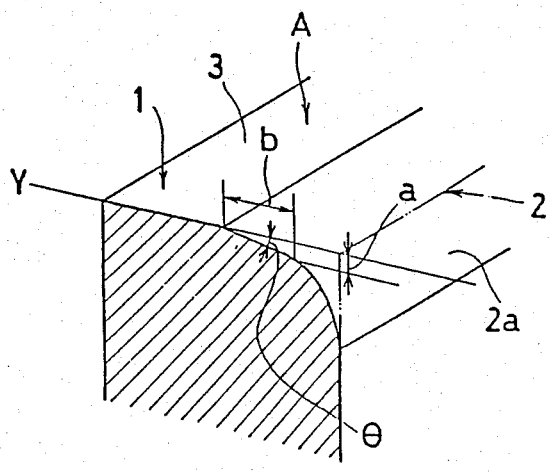
FIG. 2 is a cross-sectional view, on an enlarged scale, showing a sectional profile of the floppy disc head taken in a direction parallel to the direction of the short axis.

The above described equation (I) satisfies this condition within a practically acceptable framework. By way of example, when r=105 mm and L=5.5 mm, then, it will be readily seen from FIG. 4 that the value of the distance x can be smaller than 4.0 mm.

On the other hand, if r=105 mm and L=5.5 mm, the minimum value for the distance x which satisfies equation (I) will be $x=r(0.015+(L/2r)=4.3$ mm. Although this value of 4.3 mm is somewhat greater than the previously described value of 4.0 mm for the distance x, it satisfies, within the practically acceptable framework, the condition in which the space W is greater than 20 $\mu$m. (Note that when x=4.3 mm, the space W will be about 19 m as seen from FIG. 9.)

The edge-rounding method according to the present invention can bring about the following effects:

(11) Since the grinding method steps employed in the method of the present invention include a step in which the grinding is basically carried out at the outer periphery of a rigid cylinder, and since the shape of the to-be-ground surface of each workpiece is determined by the geometry of the positions of the workpiece and the grinding device, the highly precisely ground workpieces having the stabilized ground surface can be manufactured in contrast to the conventional method wherein the elastic deformation of the elastic sheet is utilized. Therefore, the quality of the ultimate products can be rendered uniform and excellent.

(22) Since the method of the present invention is carried out with the spacing x so selected as to satisfy the above described equation (I), it is possible to restrict the inclination angle $\theta$ at the transition point of the to-be-ground surface substantially to a value smaller than 0.86°, which is a standardized value. Therefore, the edge-rounding which requires highly precise care can be assuredly and stably performed. Moreover, even though a change occurs in the type and size of the workpieces, the grinding conditions can readily be determined based on equation (I).

(33) With the method according to the present invention, plural workpieces can be simultaneously edge-rounded under the same conditions as shown in FIGS. 8 and 9, and, moreover, any possible deviation in quality among the ultimate products can be eliminated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method for edge rounding a workpiece having a longitudinal axis and a planar surface disposed perpendicular to said longitudinal axis, said method being for chamfering the peripheral edge of the planar surface by grinding, said method comprising steps of:

rotating a cylindrical surface grinding means having a right circular cylindrical grinding surface disposed at a constant radius of curvature from the axis of rotation thereof and grinding media thereon around the axis of rotation thereof to move the grinding surface in the circumferential direction thereof;

supporting the workpiece on the end of a workpiece holder means having a longitudinal axis with the longitudinal axis of the workpiece aligned with the longitudinal axis of said workpiece holder means;

rotating said workpiece holder means around the longitudinal axis thereof to rotate the planar surface perpendicular to the axis of the workpiece around the longitudinal axis of the workpiece;

placing the longitudinal axis of said workpiece holder means parallel to a radius of said grinding means and spaced laterally of said radius a predetermined distance less than the radius and moving said workpiece holder means along the longitudinal axis thereof for engaging the peripheral edge of the planar surface with the cylindrical surface of said grinding means;

urging said workpiece holder means along the longitudinal axis thereof toward said cylindrical surface for holding the peripheral edge under pressure against said cylindrical surface; and pivoting said workpiece holder means in a first plane containing the longitudinal axis thereof within a range from the position parallel to said radius up to a predetermined maximum angle on opposite sides of said parallel position, said first plane being parallel to a second plane containing said radius and the axis of rotation of said grinding means and said pivoting being about a pivot axis substantially through the point of intersection of the longitudinal axis of said workpiece holder means and the cylindrical surface and perpendicular to said first plane.

2. The method as claimed in claim 1 in which said grinding means is a right circular cylinder and said longitudinal axis of said workpiece holder means is spaced from said radius in a direction the same as the direction of rotation of the cylindrical surface of said grinding means.

3. A method as claimed in claim 1 wherein the pivotal movement of the workpiece is within a predetermined equal angle on opposite sides of said parallel position.

4. A method as claimed in claim 1 wherein the cylindrical surface grinding means is an abrasive tape moving around a rotary drum and moving in a direction for causing the surface of the tape to move toward the workpiece.

5. A method for simultaneously edge rounding a plurality of workpieces and having a longitudinal axis and a planar surface disposed perpendicular to said longitudinal axis, said method being for chamfering the peripheral edges of the planar surfaces by grinding, said method comprising the steps of:

rotating a cylindrical surface grinding means having a right circular cylindrical grinding surface disposed at a constant radius of curvature from the axis of rotation thereof and grinding media thereon around the axis of rotation thereof to move the grinding surface in the circumferential direction thereof;

supporting the workpieces on the ends of a plurality of a workpiece holder means each having a longitudinal axis with the longitudinal axis of the workpiece aligned with the longitudinal axis of said workpiece hold means, the longitudinal axis of said workpiece holder means being parallel to each other;

rotating each of said workpiece holder means around the longitudinal axis thereof to rotate the planar surface of the workpiece held thereby perpendicular to the axis of the workpiece around the longitudinal axis of the workpiece;

placing the workpiece holder means with a first plane containing the longitudinal axis thereof parallel to a second plane containing a radius of said grinding means and the axis of rotation of said grinding means and spaced laterally of said second plane a predetermined distance less than the radius and moving said workpiece holder means along the longitudinal axis thereof for engaging the peripheral edges of the planar surfaces with the cylindrical surface of said grinding means;

urging said workpiece holder means along the longitudinal axis thereof toward said cylindrical surface for holding the peripheral edges of the workpieces, under pressure against said cylindrical surface; and pivoting each of said workpiece holder means in said first plane within a range from the position parallel to said radius up to a predetermined maximum angle on opposite sides of said parallel position and while keeping the workpiece holders parallel to each other, said pivoting being about a pivot axis and extending substantially through the point of intersection of the longitudinal axis of the respective workpiece holder means and the cylindrical surface and perpendicular to said first plane.

6. An apparatus for edge rounding a workpiece having a longitudinal axis and a planar surface disposed perpendicular to said longitudinal axis, said apparatus being for chamfering the peripheral edge of the planar surface by grinding, said apparatus comprising:

a cylindrical surface grinding means having a right circular cylindrical grinding surface disposed at a constant radius of curvature from the axis of rotation thereof and grinding media thereon, and means for rotating said grinding means around the axis of rotation thereof to move the cylindrical surface in the circumferential direction thereof;

a workpiece holder means having a longitudinal axis for supporting the workpiece on the end thereof with the longitudinal axis of the workpiece aligned with the longitudinal axis of said workpiece holder means;

means for rotating said workpiece holder means around the longitudinal axis thereof to rotate the planar surface perpendicular to the axis of the workpiece around the longitudinal axis of the workpiece, the longitudinal axis of said workpiece holder means being parallel to a radius of said grinding means and spaced laterally of said radius a predetermined distance less than the radius in the direction of rotation of said grinding means engaged with said workpiece holder means for urging said workpiece holder means along the longitudinal axis thereof toward said cylindrical surface of engaging and holding the peripheral edge under pressure against said cylindrical surface; and means connected to said workpiece holder means for pivoting said workpiece holder means in a first plane containing the longitudinal axis thereof within a range from the position parallel to said radius up to a predetermined maximum angle on opposite sides of said parallel position, said first plane being parallel to a second plane containing said radius and the axis of rotation of said grinding means and said pivoting being about a pivot axis substantially through the point of intersection of the longitudinal axis of said workpiece holder means and the cylindrical surface and perpendicular to said first plane of said grinding means.

7. An apparatus as claimed in claim 6 in which said grinding means comprises a right circular grinding cylinder.

8. An apparatus as claimed in claim 6 in which said grinding means comprises an abrasive tape, and a rotatable cylindrical drum over which said tape moves.

9. An apparatus for edge rounding a plurality of workpieces each having a longitudinal axis and a planar surface disposed perpendicular to said longitudinal axis, said apparatus being for chamfering the peripheral edges of the planar surfaces by grinding, said apparatus comprising:

a workpiece holder carrying means movable along a workpiece transport path;

a plurality of grinding stations spaced along said transport path, at least one grinding station being a precylindrical grinding zone and comprising a first grinding device having a right circular grinding cylinder having an outer right cylindrical grinding surface and means for rotating said grinding cylinder around the cylindrical axis thereof, and at least one grinding station being a post grinding zone and comprising a right circular cylindrical rotary drum and an abrasive tape movable around said drum and having the outer surface thereof constituting a grinding surface and means for rotating said rotary drum for moving said tape therearound;

a plurality of workpiece holder means mounted on said carrying means and each having a longitudinal axis for supporting a workpiece on the end thereof with the longitudinal axis of the workpiece aligned with the longitudinal axis of said workpiece holder means;

means for rotating each of said workpiece holder means around the longitudinal axis thereof to rotate the planar surface perpendicular to the axis of the workpiece around the longitudinal axis of the workpiece, the longitudinal axis of said workpiece holder means being in a first plane which, when said carrying means is at one of said grinding stations, is parallel to a second plane containing a radius of the grinding device and the axis of rotation of the grinding device and which first plane is spaced laterally of said second plane a predetermined distance less than the radius of the respective grinding devices;

means engaged with said workpiece holder means for urging said workpiece holder means along the longitudinal axis thereof toward the grinding surface for engaging and holding the peripheral edges under pressure against the grinding surface; and means connected to said workpiece holder means for simultaneously pivoting said workpiece holder means in said first plane within a range from the position parallel to said radius up to a predetermined maximum angle on opposite sides of said parallel position, said pivoting being about respective pivot axis each extending substantially through the point of intersection of the longitudinal axis of the respective workpiece holder means and the grinding surface and perpendicular to said first plane.

10. An apparatus as claimed in claim 9 wherein there is a plurality of grinding stations in said pre-grinding zone each having a first grinding device.

11. An apparatus as claimed in claim 9 wherein there is a plurality of grinding stations in said post-grinding zone each having a second grinding device.

12. An apparatus as claimed in claim 9 further comprising a cleaning station between the pre-grinding and post-grinding zones, said cleaning station having an ultrasonic cleaning device thereat for cleaning workpiece which have been ground in said pre-grinding zone.

13. An apparatus as claimed in claim 9 wherein said workpiece holder carrying means comprises an indexing turntable and a rotary indexing means connected to said turntable for sequentially transporting workpieces past said grinding stations.

* * * * *